US007810882B2

(12) United States Patent
Bartlmae et al.

(10) Patent No.: US 7,810,882 B2
(45) Date of Patent: Oct. 12, 2010

(54) GANGING DEVICE FOR CHAIR

(75) Inventors: Kerstin Bartlmae, Via Simone Stefani 20B, S. Margherita Lig. (ge) (IT) I-16038; Brian E. Williams, Ida, MI (US)

(73) Assignee: Kerstin Bartlmae, S. Margherita Lig. (ge) (IT)

( * ) Notice: Subject to any disclaimer, the term of this patent is extended or adjusted under 35 U.S.C. 154(b) by 26 days.

(21) Appl. No.: 12/117,235

(22) Filed: May 8, 2008

(65) Prior Publication Data

US 2009/0058155 A1 Mar. 5, 2009

Related U.S. Application Data

(60) Provisional application No. 60/916,650, filed on May 8, 2007.

(51) Int. Cl.
*A47C 15/00* (2006.01)
*A47C 3/04* (2006.01)

(52) U.S. Cl. ..... 297/248; 297/239

(58) Field of Classification Search ..... 297/239, 297/248

See application file for complete search history.

(56) References Cited

U.S. PATENT DOCUMENTS 390,909 A * 10/1888 Seip ..... 297/250.1

(Continued)

FOREIGN PATENT DOCUMENTS

EP 0195647 9/1986

OTHER PUBLICATIONS

Photograph of stacked chairs with ganging devices (believed to have been offered for sale, publicly used, and/or published prior to the filing date of this application).

(Continued)

*Primary Examiner*—David Dunn
*Assistant Examiner*—Tania Abraham
(74) *Attorney, Agent, or Firm*—Gifford, Krass, Sprinkle, Anderson & Citkowski, P.C.

(57) ABSTRACT

A connectable chair has a frame for supporting a seat and a back support. The frame including a pair of spaced apart leg members. A female ganging device and a corresponding male ganging device both have a mounting portion and an engagement portion. The engagement portion interconnects like chairs in a side-by-side relationship. The mounting portion secures the female and male ganging device to opposite sides of the frame. The female ganging further includes a receiving slot extending across the engagement portion. The male ganging device further includes an elongated flange extending across the engagement portion. The flange of the male ganging device may be received by the receiving slot of the female ganging device of a like chair thereby providing for the interconnection of a plurality of connectable chairs in a side-by-side relationship.

15 Claims, 6 Drawing Sheets

U.S. PATENT DOCUMENTS

| | | | | | |
|---|---|---|---|---|---|
| 3,278,227 | A | * | 10/1966 | Rowland | 297/239 |
| 3,380,778 | A | * | 4/1968 | Barecki | 297/451.1 |
| 3,610,686 | A | * | 10/1971 | Caruso | 297/239 |
| 3,755,853 | A | * | 9/1973 | Barile | 16/42 R |
| 3,758,155 | A | * | 9/1973 | Straits | 297/248 |
| 3,982,785 | A | * | 9/1976 | Ambasz | 297/160 |
| 4,084,850 | A | * | 4/1978 | Ambasz | 297/317 |
| 4,978,168 | A | | 12/1990 | Piretti et al. | |
| 5,509,720 | A | * | 4/1996 | Croom | 297/440.14 |
| 5,957,530 | A | | 9/1999 | Gutgsell | |
| 6,206,469 | B1 | | 3/2001 | Caruso et al. | |
| 6,820,934 | B2 | * | 11/2004 | Ware et al. | 297/285 |
| 6,860,556 | B2 | * | 3/2005 | Barile et al. | 297/239 |
| 6,866,338 | B2 | * | 3/2005 | Mendenhall et al. | 297/239 |
| 7,014,268 | B2 | * | 3/2006 | Socha et al. | 297/448.1 |
| 2002/0153754 | A1 | * | 10/2002 | Huang | 297/239 |

OTHER PUBLICATIONS

Photograph of ganging devices (believed to have been offered for sale, publicly used, and/or published prior to the filing date of this application).

Photograph of chair and ganging device (believed to have been offered for sale, publicly used, and/or published prior to the filing date of this application).

* cited by examiner

GANGING DEVICE FOR CHAIR

CROSS REFERENCE TO RELATED APPLICATION

This application claims the benefit of U.S. provisional application Ser. No. 60/916,650 filed May 8, 2007.

BACKGROUND OF THE INVENTION

1. Field of the Invention

The present invention relates generally to ganging devices for interconnecting a pair of chairs placed side by side.

2. Description of the Prior Art

Chairs used in convention halls, auditoriums, banquet halls and other facilities often need to be arranged into rows, often on a temporary basis. It is sometimes desirable to arrange interlocking chairs into straight rows, which may be referred to as "ganging" the chairs. It is known to provide ganging devices or ganger brackets for interlocking each chair with its immediately adjacent neighboring chair or chairs. Ganger brackets typically take the form of some type of hook extending from one side of the chair and a corresponding engagement loop or surface on the opposite side of the chair. Two identical chairs may be interlocked by engaging the hook portion of one chair with the loop or surface of its neighboring chair.

U.S. Pat. No. 6,206,469 to Caruso et al. and U.S. Pat. No. 4,978,168 to Piretti et al. disclose interconnecting chairs with ganging devices. Both teach a ganging device including a hook and a loop disposed on opposite sides of a chair. The chairs are interconnected in a side-by-side relationship by engaging the hook of one chair under the loop of another chair. Accordingly, it is difficult to remove a chair with a neighboring chair to its left and right because the hook and loop obstruct the ability of the chair to be lifted from its engaged position.

U.S. Pat. No. 5,957,530 to Gutgsell discloses an interconnecting chair with a ganging device. The ganging device is a bracket with a pivot end and a ganging end. The pivoting end is pivotable clipped to the underside of a chair and is pivoted upward such that the ganging end engages a leg member of a similarly equipped chair. Though Gutgsell teaches that the chair interconnected with chairs to its left and right is able to be removed therefrom individually, Gutgsell requires the use of a moving part to do so. Thus over time, the moving part is susceptible to wear and increase the manufacturing cost of the chair relative to the configurations taught in Caruso et al. and Piretti et al. Accordingly, it is desirable to have a chair capable of being interconnected with other like chairs whereby the removal of a chair interconnected with chairs on both sides is done easily and without the manufacturing costs and potential wearing of a part that is associated with Gutgsell.

SUMMARY OF THE INVENTION AND ADVANTAGES

A connectable chair has a seat, a back support, and a frame for supporting the seat and back support. The frame includes a pair of spaced apart leg members. Each leg member has a front leg portion and a rear leg portion. The pair of leg members includes a connecting portion interconnecting the front leg portion to the rear leg portion. The connecting portion is curved to give the leg member a generally "V" or "U" shape. A glide is disposed on the front and rear leg portion of each leg member. Each glide has a shape to fittingly receive the top surface of the leg members of a like chair. A seat support member extends between the pair of spaced apart leg members, and a back support member extends from the frame to the back support. A female ganging device and a corresponding male ganging device both have a mounting portion and an engagement portion which are used to interconnect like chairs in a side-by-side relationship. The mounting portion is fittingly received by the support member and secures the female and male ganging device thereto. The female ganging further includes a receiving slot extending across the outer face of the engagement portion. The female ganging device is interconnected with one side of the frame, and the male ganging device is interconnected with the side of the frame opposite the female ganging device. The male ganging device further includes an elongated flange extending across the outer face, wherein the flange of the male ganging device may be received into either end of the receiving slot of the female ganging device of a like chair thereby providing for the interconnection of a plurality of the connectable chairs in a side-by-side relationship.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

The present invention provides embodiments of a chair 10 having a ganging device for interlocking or "ganging" a plurality of chairs 10 in a side-by-side relationship to each other.

Figure 1:
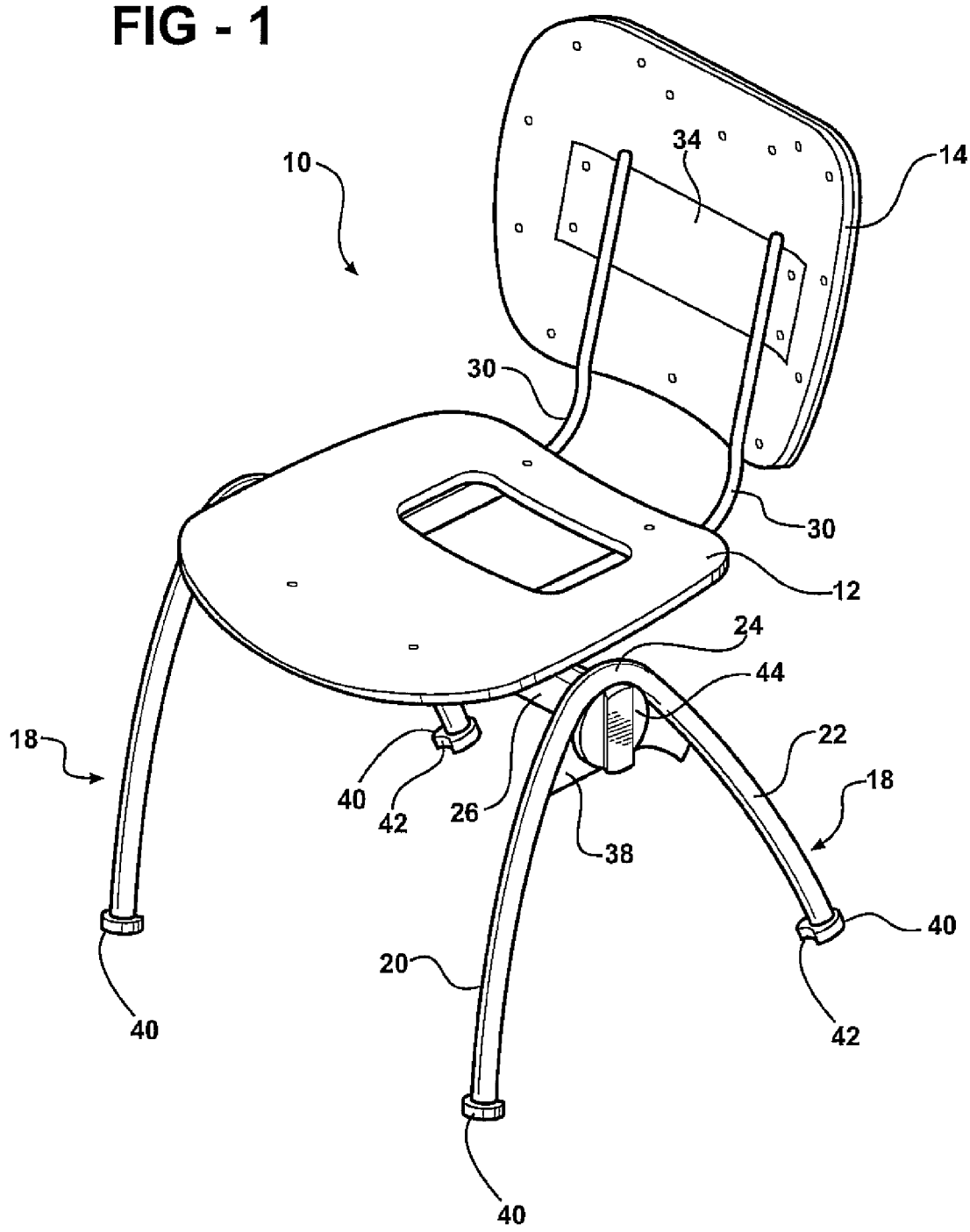
FIG. 1 is a perspective view of a chair with a ganging device according to an embodiment of the present invention.

FIG. 1 illustrates a chair 10 according to an embodiment of the present invention. The chair 10 includes a seat 12 disposed generally horizontal to a planar surface, a back support 14 and a frame 16 for supporting the seat 12 and back support 14. The frame 16 includes a pair of spaced apart leg members 18 for supporting the seat 12 and back support 14. Each leg member 18 has a front leg portion 20 and a rear leg portion 22. A curved connecting portion 24 interconnects the front leg portion 20 to the rear leg portion 22, giving the leg members 18 the general shape of an inverted "U" or inverted "V." The leg members 18 are similar, so only one leg member 18 will be described in detail.

Figure 2B:
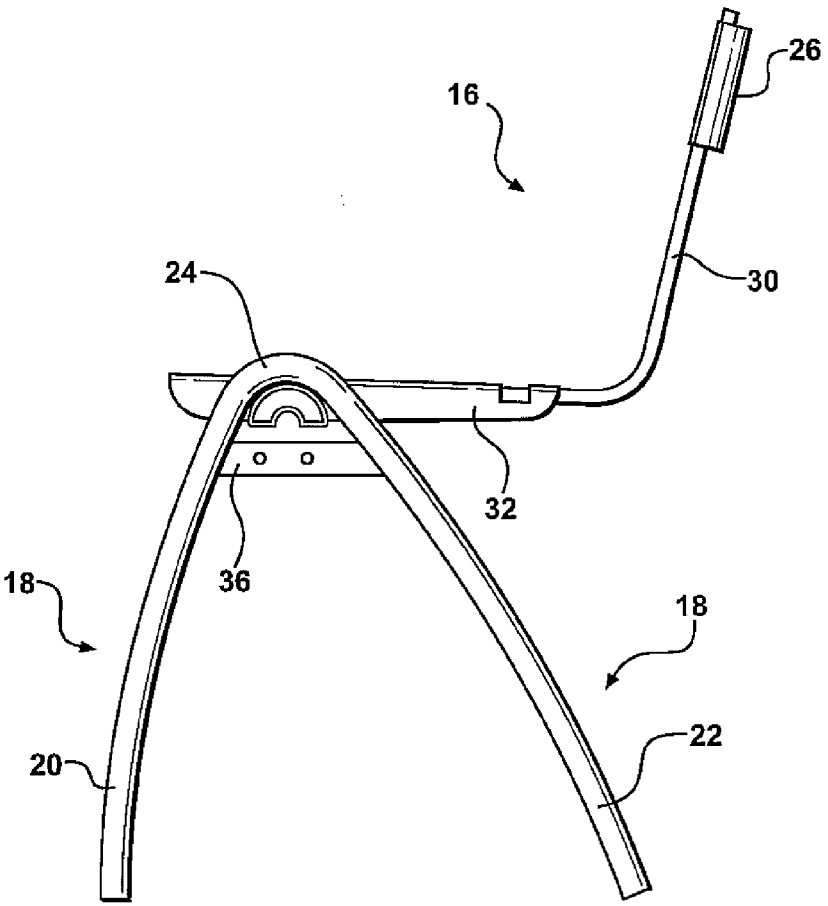
FIGS. 2*a* and 2*b* provide views of the frame of the chair of FIG. 1 looking from the top down and from the side respectively.
Figure 2A:
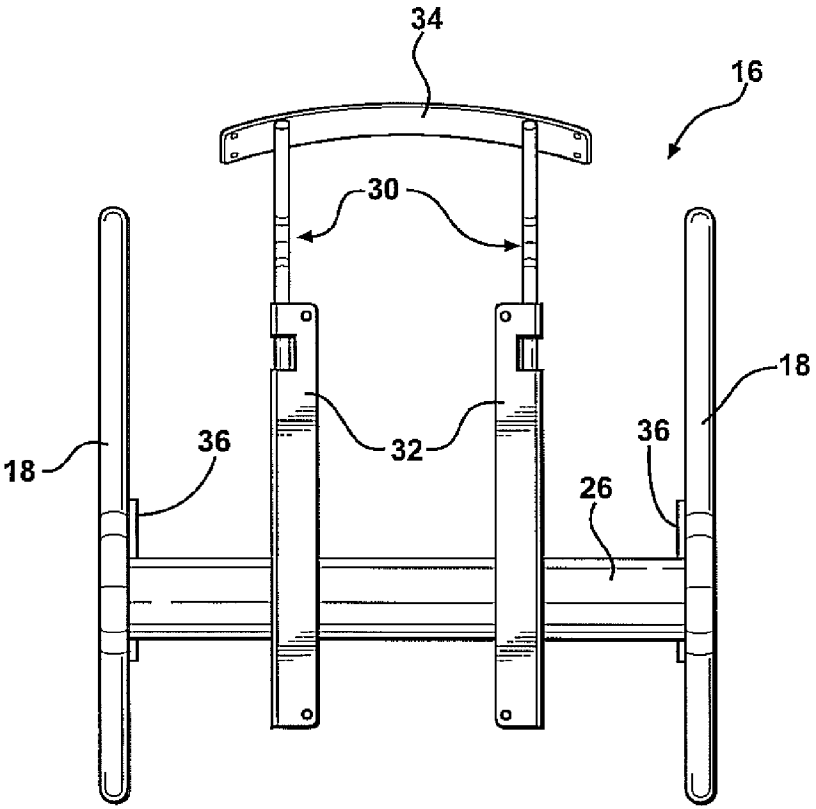

With reference now to FIGS. 2*a* and 2*b* two different views of the frame 16 are provided. The chair 10 also includes a generally horizontal seat support member 26 that extends between the pair of spaced apart leg members 18. One end of the seat support member 26 is interconnected with the connecting portion 24 of one of the leg members 18 and the other end of the seat support member 26 is interconnected with the connecting portion 24 of the other leg members 18. One embodiment of the seat support member 26 takes the form of a half-round tube with a curved upper surface and a generally flattened lower surface. The lower surface includes an indent 28 to give the half-round tube a C shaped profile. The frame 16 also includes a back support member 30 extending from the frame 16 to the back support 14, to provide support for the back support 14. The frame 16 may include additional elements such as a pair of seat support brackets 32, back support bracket 34, and a leg reinforcement member 36. The frame 16 may be interconnected with these brackets 32, 34 thereby providing more support and stability to the seat 12 and back support 14. The leg reinforcement member extends between the front portion and rear portion of each leg member to help prevent the legs from spreading apart from each other due to loads place on the seat as a result of use or stacking. The chair 10 in FIG. 1 is illustrated without upholstery, though it is preferred that the seat 12 and back support 14 are covered with upholstery.

Figure 3:
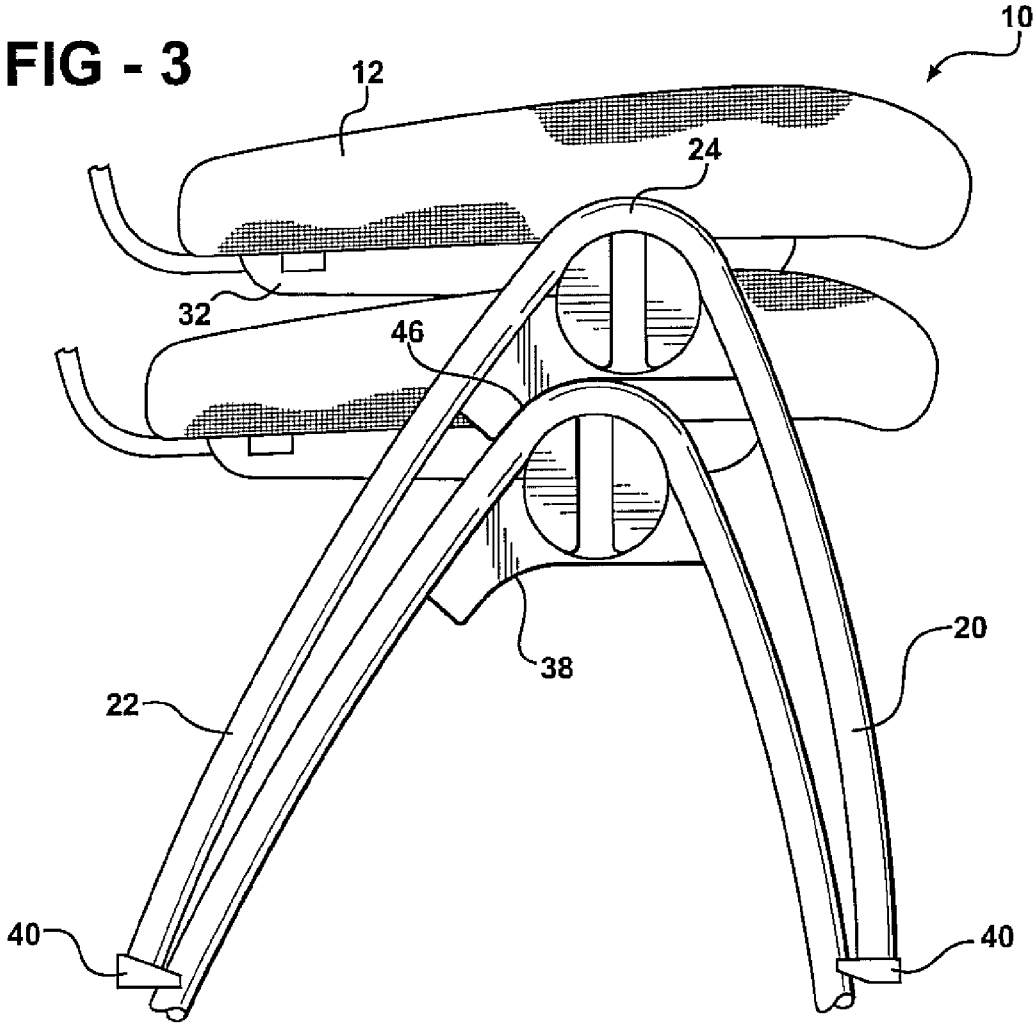
FIG. 3 is a side view of like chairs of FIG. 1 fitted with upholstery arranged into a stack.

The chair 10 in FIG. 1 is also designed to help align upper chair 10 to a lower chair 10 of the same likeness such that multiple chairs 10 may be stacked one atop another for storage or transportation as shown in FIG. 3. Accordingly, the shape of the leg members 18 is such that the leg members 18 of an upper chair 10 may rest on and be supported by the leg members 18 of a lower chair 10. A stacking member 38 is also provided to further help with the alignment of stacked like chairs 10. The stacking member 38 is disposed on each of the pair of leg members 18 and extends between the upper part of the rear leg portion 22 to the upper part of the front leg portion 20, and is shaped to receive the connecting portion 24 of a like chair 10 such that the stacking member 38 rests on the connecting portion 24 of a like chair 10. The stacking member 38 cooperates with the glides 40 to maintain the position of each stacking chair 10 in a stack with respect to the other to help ensure that the stacked chairs 10 do not collapse and to align the stacking chairs 10 when stacked on top of another. The stacking members 38 are preferably formed of a polymeric material.

Referring again to FIG. 1, glides 40 are preferably disposed on the lower end of each of the front and rear leg portions 20, 22. The glides 40 have a shape to fittingly receive the top surface of the pair of spaced apart leg members 18. Specifically, the inward facing side of the glide 40 has a concave face 42 that engages the outer surface of a leg portion of a lower chair 10 when an upper chair 10 with the glide 40 is stacked thereon. The glide 40 is preferably a polymer material that allows the chair 10 to be moved without scratching a flooring surface.

Figure 4:
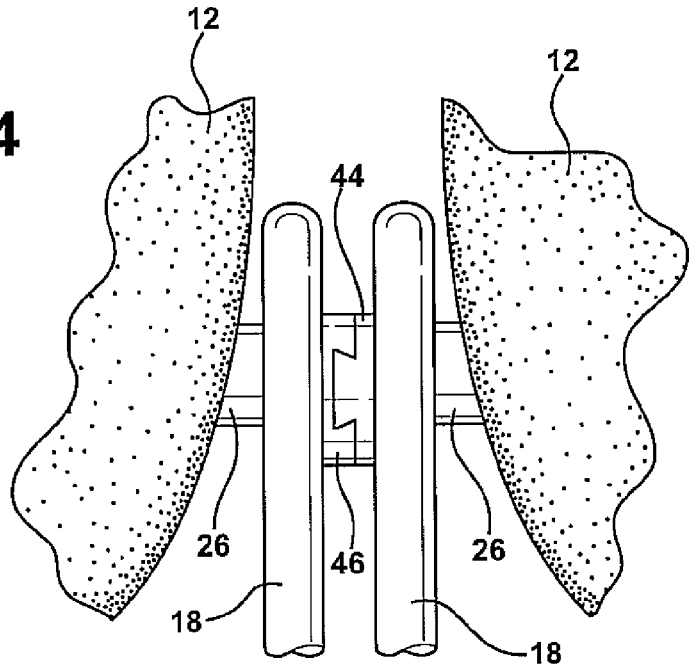
FIG. 4 is a top view of a portion of the chair of FIG. 1 interconnected with a like chair in a side-by-side relationship.

The chair 10 is fitted with a male and female ganging device 44, 46 to allow the chairs 10 to interconnect in a side-by-side relationship. Referring again to FIG. 1, a male ganging device 44 is shown interconnected with a side of the chair 10 adjacent the connecting portion 24 of the leg member 18. The corresponding female ganging device 46 is provided on the other side of the chair 10, though not shown in FIG. 1. When two similar chairs 10 are arranged side by side, the ganging device of one chair 10 may engage the corresponding ganging device of an adjacent like chair 10. FIG. 4 includes a top view of a pair of ganging devices 44, 46 interconnected with one another.

Figure 5B:
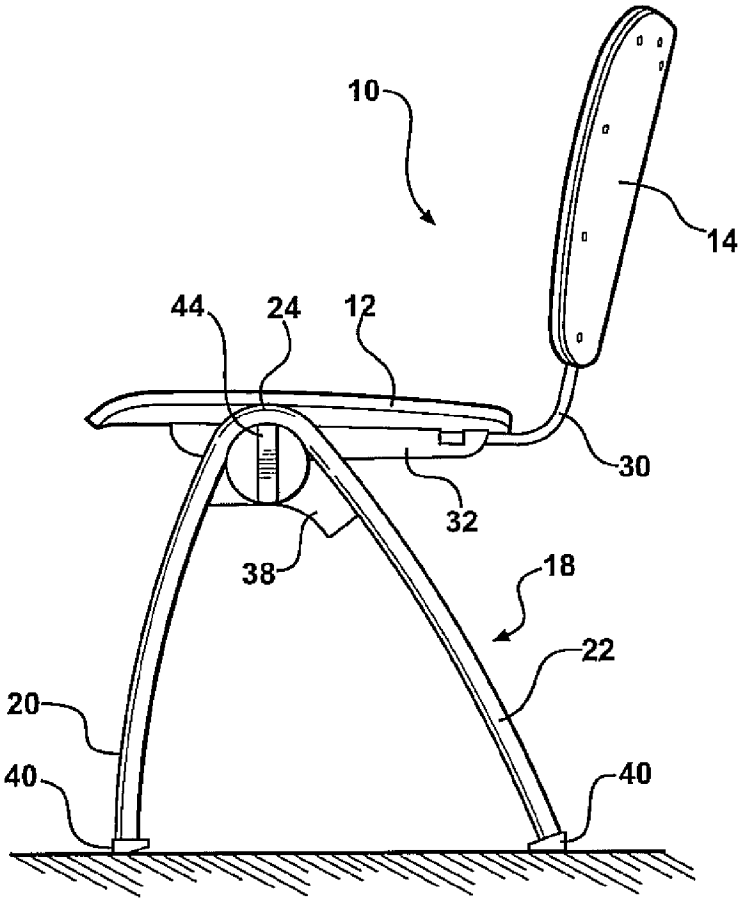
FIGS. 5*a* and 5*b* are views of the two sides of the chair of FIG. 1, showing the female ganging and the male ganging device respectively.
Figure 5A:
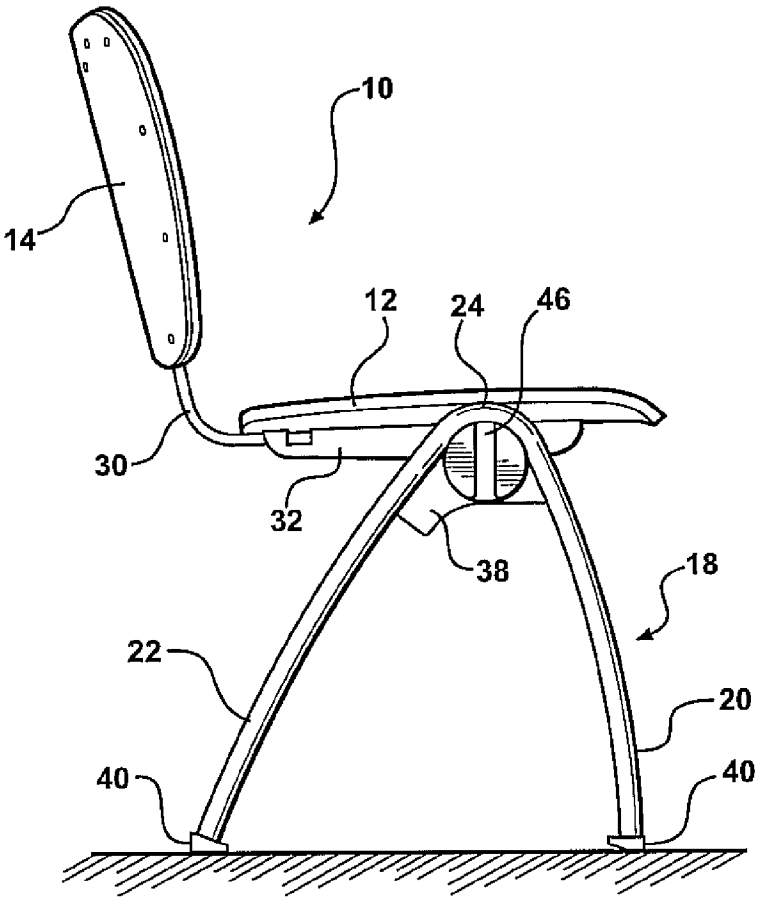

FIGS. 5*a* and 5*b* provide side views of the chair 10 of FIG. 1. The female ganging device 46 is shown on the chair 10 in FIG. 5*a* and a corresponding male ganging device 44 is shown on chair 10 in FIG. 5*b*. Now turning to FIGS. 6 and 7, a perspective view of the male and female ganging device 44, 46 is provided. Each has a mounting portion 48 and an engagement portion 50. The mounting portion 48 is fittingly received in an open end of the seat support member 26 and secures the female and male ganging device 46, 44 thereto. The engagement portion 50 includes an outer face 52, and the mounting portion 48 includes an inner face 54 opposite the outer face 52 of the engagement portion 50. The mounting portion 48 extends from the inner face 54 of the engagement portion 50. Preferably the engagement portion 50 and mounting portion 48 are integrally formed preferably out of a material such as a polymer. The mounting portion 48 has a cross-sectional shape that allows it to be received by the seat support member 26. For this purpose, the mounting portion 48 has a generally half-round cross section with a curved upper surface and a generally flattened lower surface. The lower surface may have an upward indent so as to be received into the correspondingly shaped seat support member 26 described above. As will be clear to those of skill in the art, the female and male ganging devices 46, 44 may be interchanged, as long as the ganging devices 44, 46 on corresponding chairs 10 are also interchanged.

Figure 6:
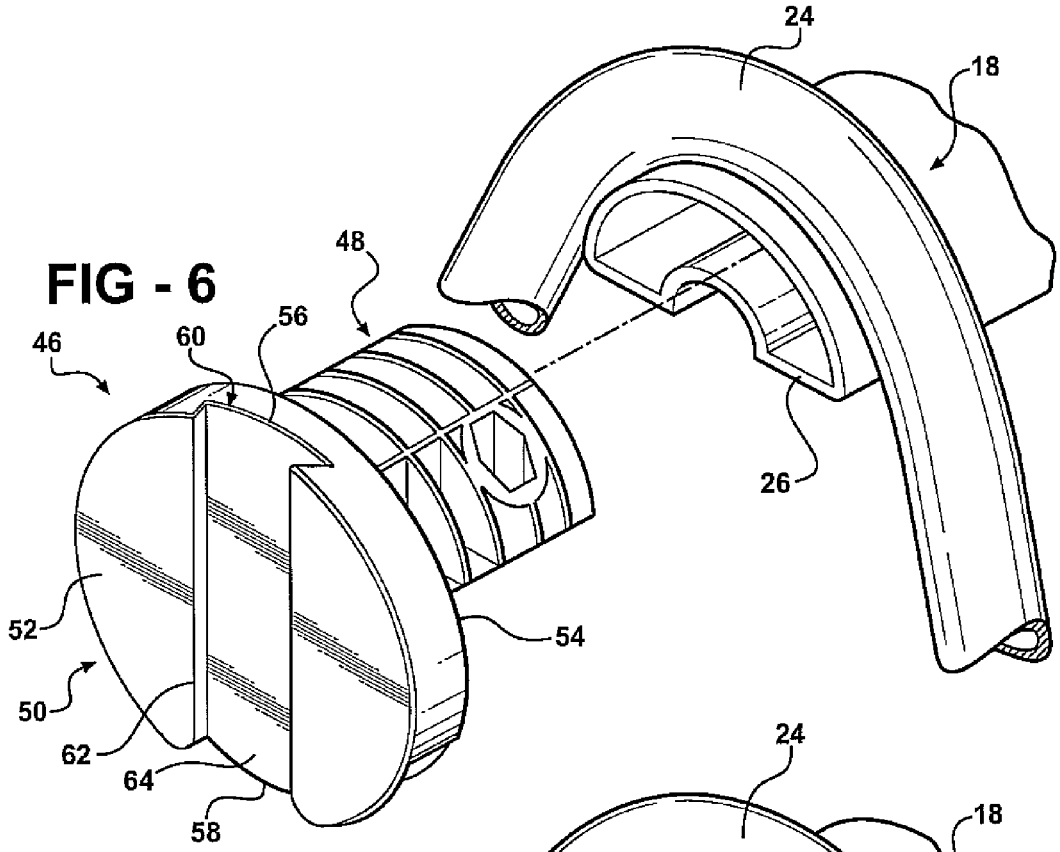
FIG. 6 is a perspective view of the female ganging device and seat support member of the chair of FIG. 1, showing the engagement of the female ganging device with the seat support member.

FIG. 6 provides a perspective of the female ganging device 46 and the seat support member 26. As stated above, the female ganging device 46 is secured to the seat support member 26 and includes an engagement portion 50 and a mounting portion 48. In this embodiment, the engagement portion 50 is generally disc shaped and a generally circular perimeter interconnects the outer face 52 to the opposed inner face 54. A receiving slot 60 is defined in the outer face 52. The receiving slot 60 includes an outer opening 62 disposed on the outer face 52 and a slot bottom 64. The receiving slot 60 further includes a first end 56 spaced apart and opposite a second end 58, with the first end 56 being disposed adjacent the apex of the connecting portion 24, meaning the portion of the connecting portion 24 closest to the back support 14. The receiving slot 60 preferably extends generally vertically along the outer face 52 and has a generally constant cross section from the first end 56 to the second end 58. As shown, the receiving slot 60 preferably is defined by an outer opening 62 disposed on the outer face 52 that widens towards a slot bottom 64 to form a generally dovetail shaped slot. As will be clear to those of skill in the art, the receiving slot 60 may have other cross-sectional shapes, although it is preferred that the shape provide locking interconnection with a corresponding flange or tab 66 of a corresponding male ganging device 44. As also shown, the receiving slot 60 may be radiused at the first end 56 and/or second end 58 to ease interconnection with a corresponding flange or tab 66. In the illustrated embodiment, the slot is radiused only at its lower end.

Figure 7:
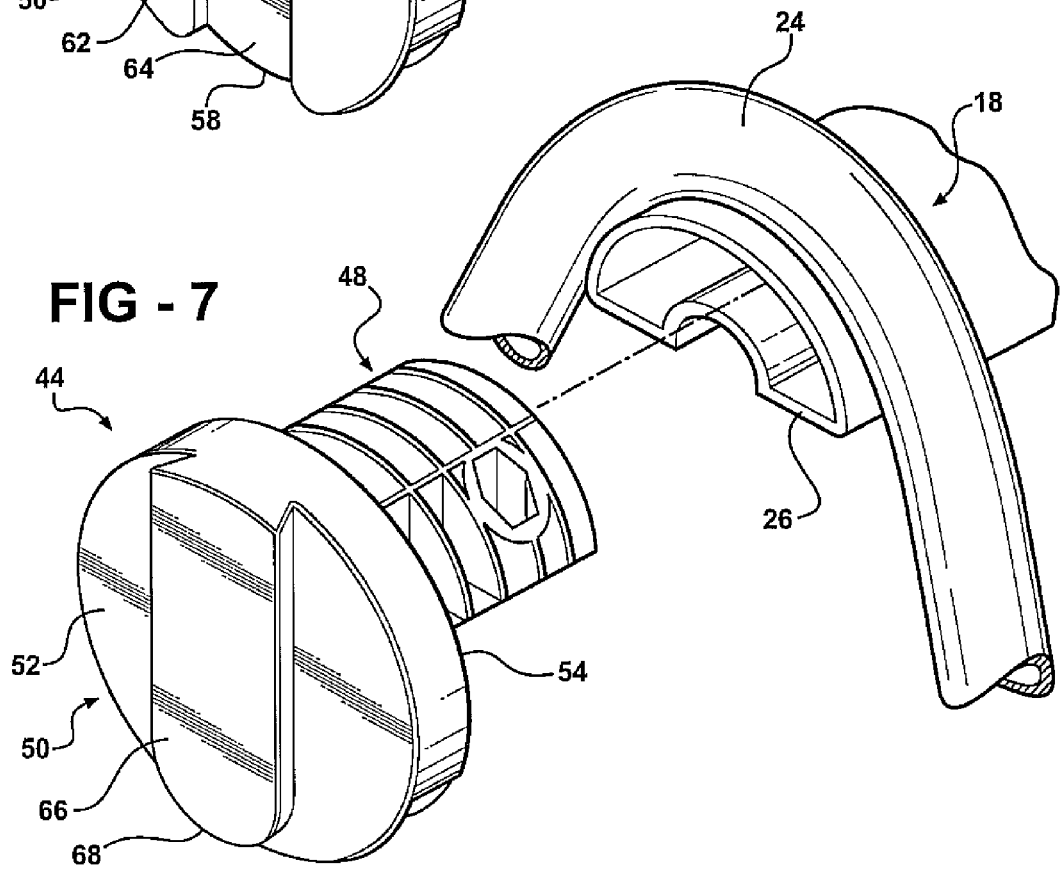
FIG. 7 is a perspective view of the male ganging device and seat support member of the chair of FIG. 1, showing the engagement of the male ganging device with the seat support member.

Referring now to FIG. 7, the corresponding male ganging device 44 is shown. The male ganging device 44 is similar to the female ganging device 46 in that it also includes an engagement portion 50 and a mounting portion 48. The engagement portion 50 is again preferably disc shaped. The male ganging device 44 is designed to interconnect with a corresponding female ganging device 46, and therefore includes a vertically elongated tab 66 or flange 66 defined on its outer face 52. The flange 66 or tab 66 has a generally constant cross section that is dovetail shaped. As with the ganging device, the flange 66 or tab 66 may have a different shape than illustrated, though it preferably has a shape corresponding to the shape of the slot in the ganging device. As illustrated, the flange 66 or tab 66 may include a radiused end or ends 68. In this embodiment, the flange 66 or tab 66 is radiused at its lower end so as to allow easier engagement with the slot in the ganging device.

Figure 8:
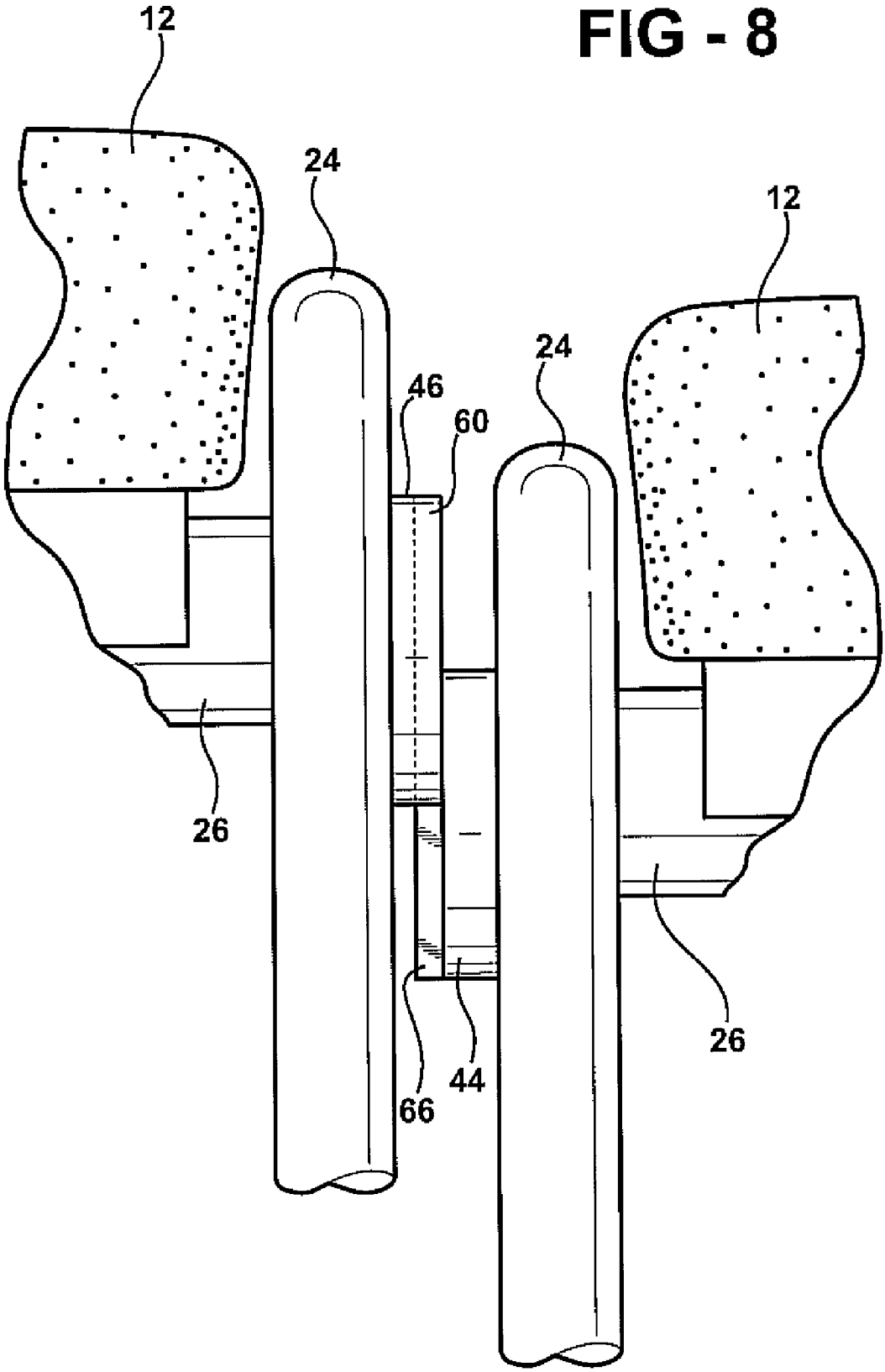
FIG. 8 is a perspective view of the female and male ganging device interconnecting two chairs in a side-by-side relationship.

Referring now to FIG. 8 and again to FIG. 4, ganging devices 44, 46 and are shown interconnected with one another with the flange 66 or tab 66 received in and engaged with the receiving slot 60. As will be clear to those of skill in the art, the tab 66 or flange 66 may pass into and through the receiving slot 60 from either the top or bottom and may be removed from the receiving slot 60 upwardly or downwardly. This provides the benefit that a pair of chairs 10 positioned side by side may be interlocked by lifting either chair 10 for engagement with the neighboring chair 10. Likewise, they could be removed by lifting either chair 10. This allows any other chair 10 in an elongated row to be lifted so as to disengage it from both of its neighboring chairs 10 thus facilitating the rearrangement of like chairs 10 interconnected to form a row. As will be clear to those of skill in the art, the shape and appearance of the ganging devices 44, 46 and may be altered from the designs illustrated and discussed herein without departing from the scope or teaching of the present invention.

Obviously, many modifications and variations of the present invention are possible in light of the above teachings and may be practiced otherwise than as specifically described while within the scope of the appended claims. In addition, the reference numerals are merely for convenience and are not to be read in any way as limiting.

The invention claimed is:

1. A connectable chair comprising:

a generally horizontal seat;

a back support;

a frame supporting the seat and back support, the frame including a pair of spaced apart leg members each having a front leg portion and a rear leg portion, a female ganging device and a male ganging device each having an outer face;

the female ganging device further including a receiving slot extending across the outer face from an edge to an opposed edge, the receiving slot having a generally constant cross section from a first end to a second end, the female ganging device interconnected with one side of the frame adjacent an upper end of one of the leg members; and the male ganging device interconnected with the side of the frame opposite the female ganging device adjacent an upper end of the other of the leg members, the male ganging device further including an elongated flange extending across the outer face, wherein the flange of the male ganging device may be received into either end of the receiving slot of the female ganging device of a like chair thereby providing for the interconnection of a plurality of the connectable chairs in a side-by-side relationship.

2. A connectable chair as set forth in claim 1, wherein each of the pair of spaced apart legs having a curved connecting portion interconnecting the front leg portion to the rear leg portion.

3. A connectable chair as set forth in claim 1, wherein the frame includes a seat support member extending between the pair of spaced apart legs, and a back support member extending from the frame to the back support.

4. A connectable chair as set forth in claim 3, wherein the seat support member is a hollow tube having a curved upper surface and a generally flattened lower surface.

5. A connectable chair as set forth in claim 4, wherein the female and male ganger each have a mounting portion and an engagement portion, the mounting portions each fittingly received by the support member and securing the female and male ganging device thereto.

6. A connectable chair as set forth in claim 1, further including a glide disposed on the front and rear leg portion of each of the pair of spaced apart legs, each glide having a shape to fittingly receive the top surface of the pair of spaced apart leg members.

7. A connectable chair as set forth in claim 1, wherein the receiving slot of the female ganging device includes an outer opening and a slot bottom, the outer opening widening towards the receiving slot bottom to form a dovetail shape.

8. A connectable chair as set forth in claim 7, wherein the slot of the female ganging device further includes a first end and a second end, each end being radiused to facilitate the interconnection of the female ganging device with the male ganging device.

9. A connectable chair as set forth in claim 1, wherein the receiving slot of the female ganging device extends generally vertically along the outer face.

10. A connectable chair as set forth in claim 9, wherein the flange of the male ganging device includes a radiused end to facilitate the interconnection of the female ganging device with the male ganging device.

11. A connectable chair as set forth in claim 1, wherein the flange of the male ganging device has a generally constant cross section.

12. A connectable chair as set forth in claim 1, wherein the flange of the male ganging device extends generally vertically along the outer face.

13. A connectable chair as set forth in claim 1, further including a stacking member disposed on each of the pair of spaced apart leg members, the stacking member extending between the front leg portion and the rear leg portion, and having a shape to receive the upper surface of the connecting portion of a like chair when placed thereon.

14. A connectable chair comprising:

a generally horizontal seat;

a back support;

a frame supporting the seat and back support, the frame including a pair of spaced apart leg members each having a front leg portion and a rear leg portion, and each of the pair of spaced apart legs being symmetric to each other and having a generally "V" shape;

a connecting portion interconnecting the front leg portion to the rear leg portion of each leg member, the connecting portion being curved;

a glide disposed on the front and rear leg portion of each of the pair of spaced apart legs, each glide having a shape to fittingly receive the top surface of the pair of spaced apart leg members;

a seat support member extending between the pair of spaced apart legs, the support member being a hollow tube having a C-shaped profile;

a back support member extending from the frame to the back support;

a female ganging device and a male ganging device both having a mounting portion and an engagement portion, the engagement portion having an outer face, the mounting portions fittingly received by the support member and securing the female and male ganging device thereto;

the female ganging further including a receiving slot extending generally vertically across the outer face from an edge to an opposed edge, the female ganging device interconnected with one side of the frame, the receiving slot including an outer opening disposed on the outer face and a slot bottom, the outer opening widening towards the receiving slot bottom to form a dovetail shape, the receiving slot further including a first end and a second end and each end is radiused to facilitate the interconnection of the female ganging device with the male ganging device, the receiving slot having a generally constant cross section from the first end to the second end; and the male Ranging device interconnected with the side of the frame opposite the female ganging device, the male ganging device further including a flange extending generally vertically across the outer face, the flange having a generally constant cross section and a radiused end, wherein the flange of the male ganging device may be received into either end of the receiving slot of the female ganging device of a like chair, thereby providing for the interconnection of a plurality of the connectable chairs in a side-by-side relationship.

15. The connectable chair of claim 14, wherein the hollow tube has a pair of opposed ends and the C-shaped profile is a generally constant cross sectional profile, the mounting portions of the ganging devices being fittingly received into the opposed ends of the hollow tube.

* * * * *